US006318628B1

(12) United States Patent
Pangburn

(10) Patent No.: US 6,318,628 B1
(45) Date of Patent: Nov. 20, 2001

(54) SINGLE-DOOR LOCKING MAILBOX

(76) Inventor: Daniel Wesley Pangburn, 501 Via Codo, Fullerton, CA (US) 92835-1453

( * ) Notice: Subject to any disclaimer, the term of this patent is extended or adjusted under 35 U.S.C. 154(b) by 0 days.

(21) Appl. No.: 09/565,051

(22) Filed: May 5, 2000

(51) Int. Cl.[7] ..... B65D 91/00
(52) U.S. Cl. ..... 232/17; 70/81; 70/417
(58) Field of Search ..... 232/17, 45, 41 D; 70/63, 160, 161, 162, 81, 84, 417; 292/78, 341.17, 136, 213, 346

(56) References Cited

U.S. PATENT DOCUMENTS

| | | | | |
|---|---|---|---|---|
| 3,802,619 | * | 4/1974 | Vanderveer | 232/17 |
| 4,333,603 | | 6/1982 | Carlson . | |
| 4,703,635 | | 11/1987 | Wyatt . | |
| 4,726,512 | | 2/1988 | White . | |
| 4,815,656 | | 3/1989 | Smith . | |
| 5,143,284 | * | 9/1992 | Socarras | 232/17 X |
| 5,407,126 | | 4/1995 | Coultas . | |
| 5,476,220 | * | 12/1995 | Cohoon | 232/17 |
| 5,586,718 | * | 12/1996 | Speece | 232/17 |
| 5,597,116 | | 1/1997 | Morris . | |
| 5,645,215 | | 7/1997 | Marendt . | |
| 5,692,674 | | 12/1997 | Wicker . | |
| 5,850,967 | | 12/1998 | White . | |
| 5,915,618 | | 6/1999 | Gaudet . | |
| 5,921,117 | | 7/1999 | Illguth . | |

* cited by examiner

*Primary Examiner*—B. Dayoan
*Assistant Examiner*—William L. Miller

(57) ABSTRACT

A single-door locking mailbox that includes a housing having an open end and a door pivotally mounted to the housing for closing and opening the end. The door can be fully open, near closed but not locked or fully closed. A locking assembly, with a latch which can be placed in either the locked or unlocked position with a key, is attached to the door. A catch is attached at one end to the inside of the enclosure and has a camming surface and a hole at the free end. The camming surface deflects the catch over the latch when the door is pushed closed. The hole in the catch is positioned and configured so that it captures the locked latch when the door is pushed fully closed. The catch is resilient enough to be elastically deflected over the latch. A guard over the catch shields it from being deflected by a finger or tool inserted through the mail slot by a thief. The pivot axis of the door is located with respect to the center of gravity of the door assembly so that the door is held in the closed but not locked position by gravity. The geometry of the latch and catch are such that the closing force produced by gravity can not overcome the resistance produced by the latch and catch so the door does not spontaneously move to the locked position. After the mail has been deposited, the mail carrier pushes the door fully closed which causes it to reach the locked position.

4 Claims, 3 Drawing Sheets

SINGLE-DOOR LOCKING MAILBOX

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

1. Field of Invention

This invention relates to articles of manufacture and more specifically to a single-door, lockable rural mailbox.

2. Description of the Prior Art

The following paragraph describes the general problem that this invention addresses.

Rural mailboxes are commonly characterized by a single door in the front which is readily accessible to the homeowner and the mail carrier. This easy accessibility feature, while being a distinct advantage to mail carriers, does pose certain disadvantages for the homeowner. Unauthorized persons have the same accessibility as authorized persons. Thus, articles such as packages, checks, credit cards and mail, placed in the mailbox by the mail carrier are vulnerable to theft or vandalism. Since it is not functional for mail delivery purposes to employ a rural mailbox which requires unlocking by the mail carrier, persons on a rural or residential route with conventional mailboxes have suffered the inconvenience associated with an insecure mailbox.

Security mailboxes that maintain security automatically without immediate intervening action by the homeowner provide secure storage of incoming mail by either of two methods: The first method is by either having the received mail move to a position that can not be reached through the deposit opening because of distance, or access port size, or having a barrier between the receiving and storage compartments to prevent access to the storage compartment when the receiving door is open. Access to the mail is accomplished through a second door which is locked and unlocked by the homeowner. Outgoing mail is either placed on a shelf within the accessible enclosure or in a separate enclosure. This double-door method is exploited in several patents. The added door, divider or larger size of these inventions add cost and complexity above that for the present mailbox. The second method for providing security for delivered mail uses a single door with various devices and/or procedures to provide security.

U.S. Pat. No. 5,586,718 discloses a rural type mailbox having, attached to the enclosure a pivoted catch that is urged to null position by a spring. The catch is engaged by a keyed rotatable latch on the door. Variability of friction at the pivot reduces functional reliability and the device can be defeated by a thief using a probe inserted through a mail slot to deflect and disengage the catch.

U.S. Pat. No. 5,476,220 discloses a locking device for a rural type mailbox. Turning a key rotates a cam which compresses a spring that urges a catch. The catch is prevented from engaging the latch by a spring urged pin in the latch. When the door is opened, the catch is released and moves to the locked position. When the door is closed the spring urged pin in the latch is pushed back allowing the latch to engage the catch locking the door. The device requires several parts which increase cost. Also, for proper operation, sliding friction must remain low at several locations in the device. Expected variation of friction makes the device susceptible to jamming. This device can also be defeated by a thief using a probe inserted through a mail slot to deflect and disengage the catch.

U.S. Pat. No. 514,284 uses two hinged doors and a dividing wall which add to the cost. Mail must be inserted through a slot. The slot must be small enough that a thief cannot get his hand through it. This limits the size of the slot and therefore the dimensions of mail that can be inserted.

U.S. Pat. No. 3,802,619 describes a two-door mailbox containing a pivotable shelf. The shelf supports outgoing mail where it can be picked up by the mail carrier and limits access so a thief can not reach delivered mail through the mail insertion door. Delivered mail is retrieved by the homeowner through a second lockable door. The second door and shelf increase the complexity and manufacturing cost for this approach.

BRIEF SUMMARY OF THE INVENTION

To avoid the limitations and problems with present devices and methods, and to reduce cost to a minimum, this invention relates to an improved locking mailbox.

This invention and method meet U.S. Post Office regulations for a residential mailbox, provide a minimum cost mailbox that has security for delivered mail, provides the same access for the mail carrier to pick up and deliver mail as a conventional not-locked mailbox, allows full open access to the mailbox for delivery of any size package that will fit in the mailbox and provides environmental protection for outgoing mail.

One or more embodiments of the invention described here are readily adaptable to incorporate into lockable mailboxes currently being marketed.

OBJECTS OF THE INVENTION

Objects of the present invention and method are to provide a secure mailbox that a) is as convenient for the mail carrier as a conventional not-locked rural mailbox for both pickup and delivery, b) meets Post Office Regulations for a residential mailbox, c) provides protection of delivered mail against theft or vandalism, d) provides environmental protection for outgoing mail, e) allows full access to the mailbox for delivery of any size package that will fit in the mailbox, f) can be manufactured at minimum cost.

These objects of the invention are provided by a novel device. The invention is a lock on the door of the mailbox with a latch that engages a catch in the mailbox housing. The catch is attached at one end to the housing and has a camming surface at the free end that the latch pushes against to deflect the end of the catch and accomplish engagement locking. The door can be in any of three positions; open, closed but not locked, referred to as the set position, and closed and locked. The center of gravity of the door assembly is located with respect to the door pivot axis such that gravity holds the door in the set position. The geometry of the latch and catch are such that the closing force produced by gravity can not overcome the resistance produced by the latch and catch so the door does not spontaneously move to the locked position. After the mail has been deposited, the mail carrier pushes the door closed which causes it to reach the locked position.

An alternate embodiment uses a spring detent to augment or replace gravity in holding the door in the set position. A second alternate embodiment uses a spring counterbalance to hold the door in the set position.

The door can not then be opened except by unlocking. Once the incoming mail has been removed from the mailbox the homeowner positions the lock to the locked position and the door to the set position ready for the next mail delivery. Outgoing mail is simply left in the mailbox for the mail carrier to pick up before depositing the incoming mail.

As a fail-safe feature, the conventional mail slot in the door is retained in case the homeowner fails to remove the mail and reset the door or if the door is inadvertently pushed to the closed and locked position.

DETAILED DESCRIPTION OF THE INVENTION

Figure 1:
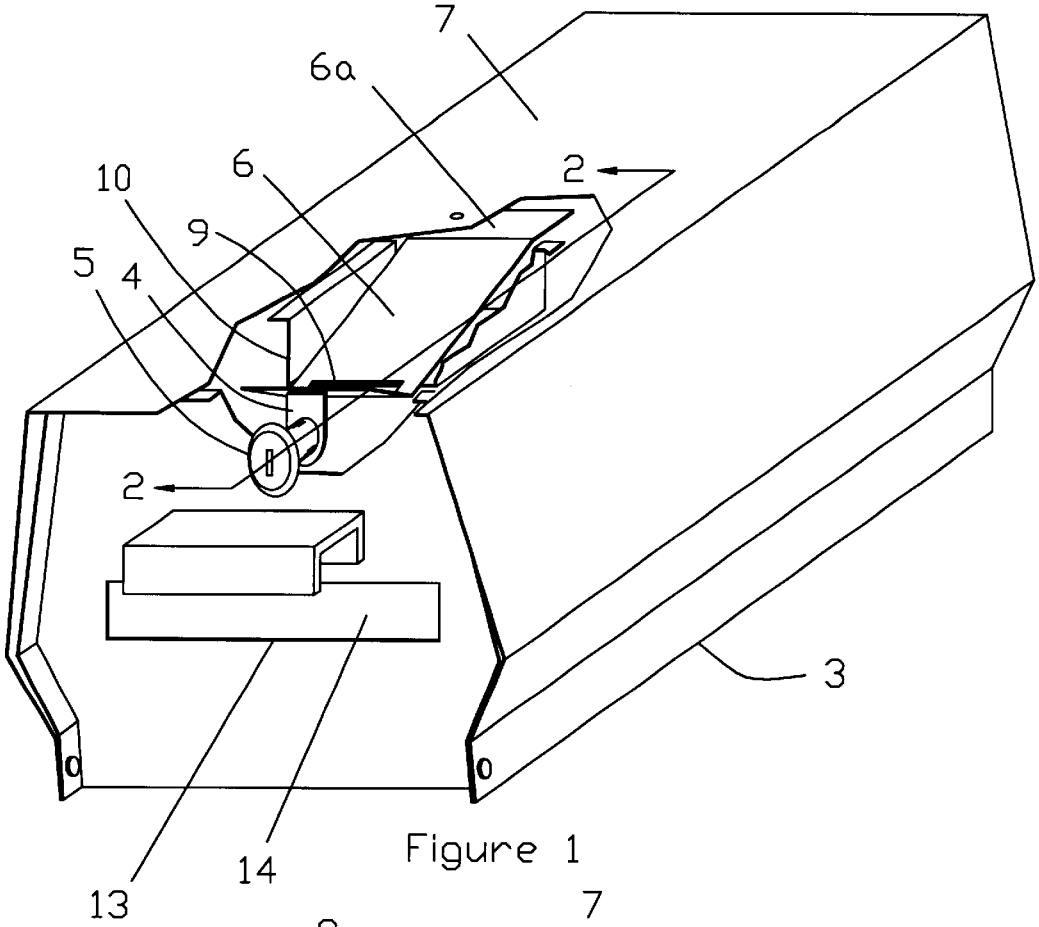
FIG. 1 is an isometric view of one embodiment of the present invention with the door in the set position.

Like reference characters designate like or corresponding parts throughout the several figures.

FIG. 1 is an isometric view of the lockable mailbox shown generally as 3.

Figure 2:
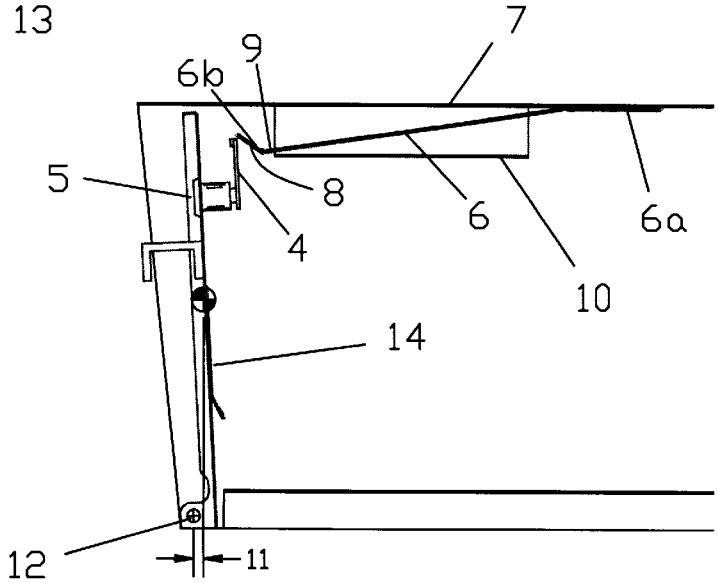
FIG. 2 is a sectional view of the present invention, taken along line 2—2 of FIG. 1.
Figure 3:
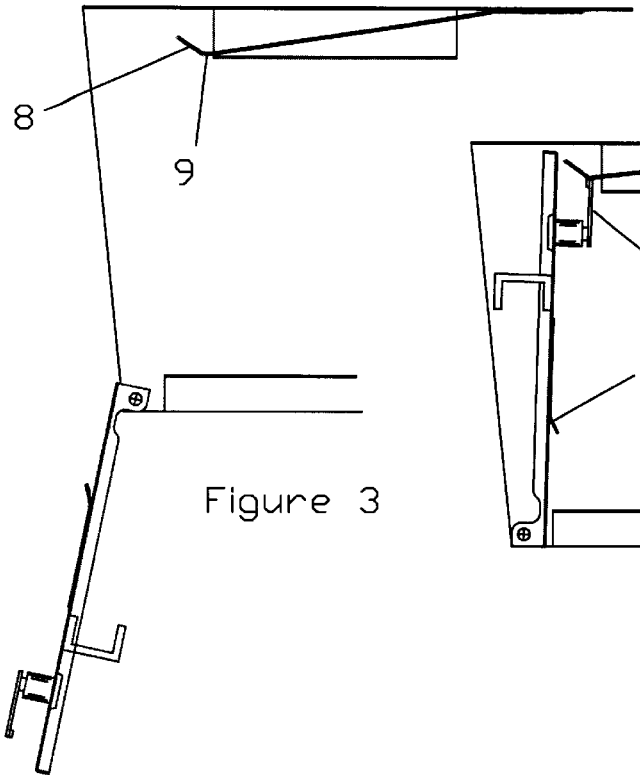
FIG. 3 is a sectional view similar to FIG. 2 but showing the door in the open position.
Figure 4:
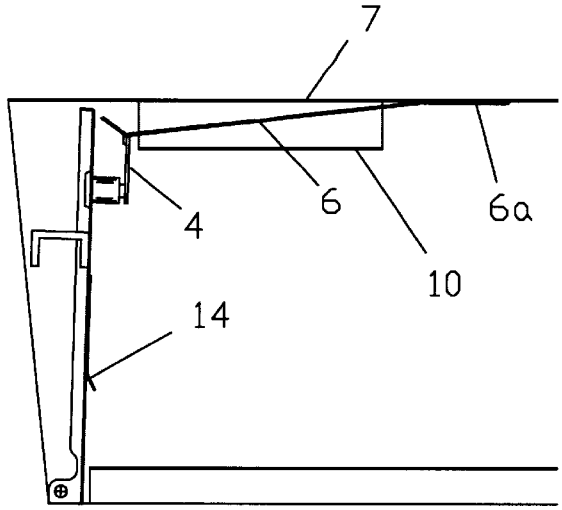
FIG. 4 is a sectional view similar to FIG. 2 but showing the door in the nearly closed position
Figure 5:
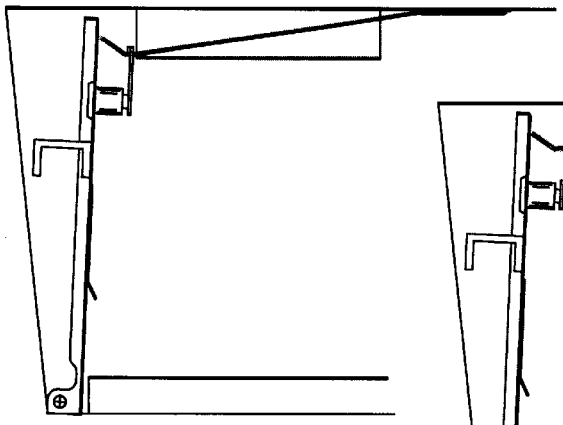
FIG. 5 is a sectional view similar to FIG. 2 but showing the door in the fully closed and locked position.

FIG. 2 shows the general configuration and relative position of the locking components. The latch, 4, is positioned to either the open or locked position by the key lock, 5. The catch, 6, is an elongated sheet metal stamping that is attached at one end, 6*a*, to the housing, 7, has a camming surface, 8, at the free end, 6*b*, and a hole, 9, adjacent to the camming surface. A guard, 10, is positioned over the catch, 6, and attached to the housing, 7, to prevent the catch, 6, from being deflected off the latch, 4, by a finger or tool inserted through the mail slot, 13, by a thief. The mail slot cover, 14, cooperates with the guard, 10, to deny a thief access to the catch, 6. The door pivot, 12, is offset from the center-of-gravity of the door assembly by some amount, 11, such that, in the set position, gravity causes the door to tend to rotate towards the housing so that the latch, 4, contacts the camming surface, 8, on the catch, 6.

Figure 6:
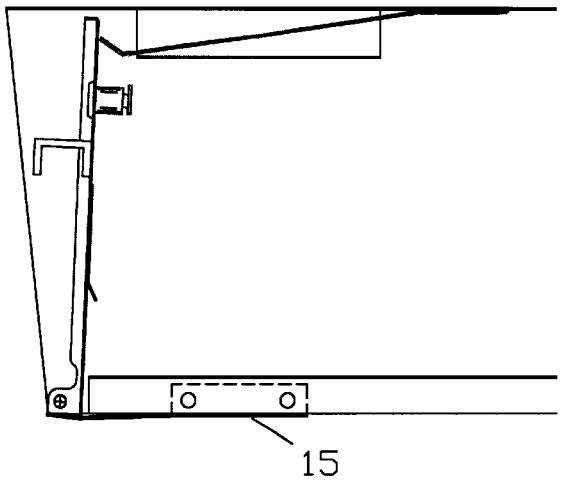
FIG. 6 is a sectional view similar to FIG. 2 but showing the door fully closed and the latch in the unlocked position.

FIG. 3, FIG. 4, FIG. 5 and FIG. 6 show alternate positions of the door. FIG. 6 also shows an alternate embodiment of the invention with a spring detent, 15, to augment gravity in holding the door in the set position.

Figure 7:
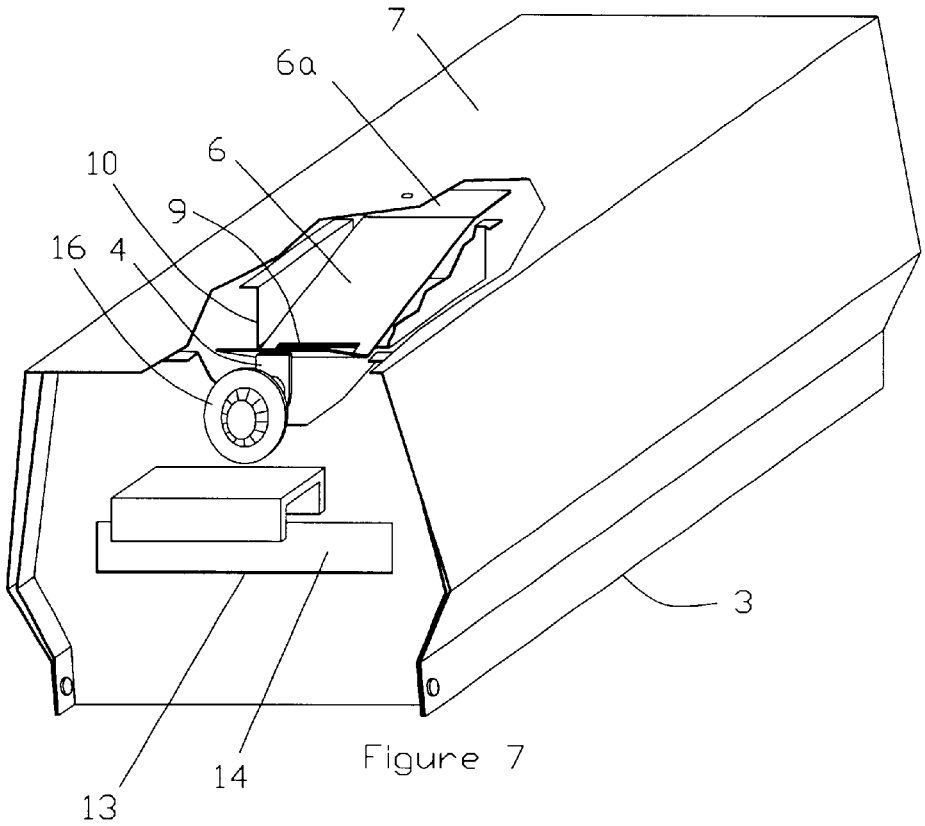
FIG. 7 is an alternate embodiment incorporating a combination lock in place of a key lock.

FIG. 7 is an isometric view similar to FIG. 1 but shows a combination lock, 16, in place of the key lock, 5.

Figure 8:
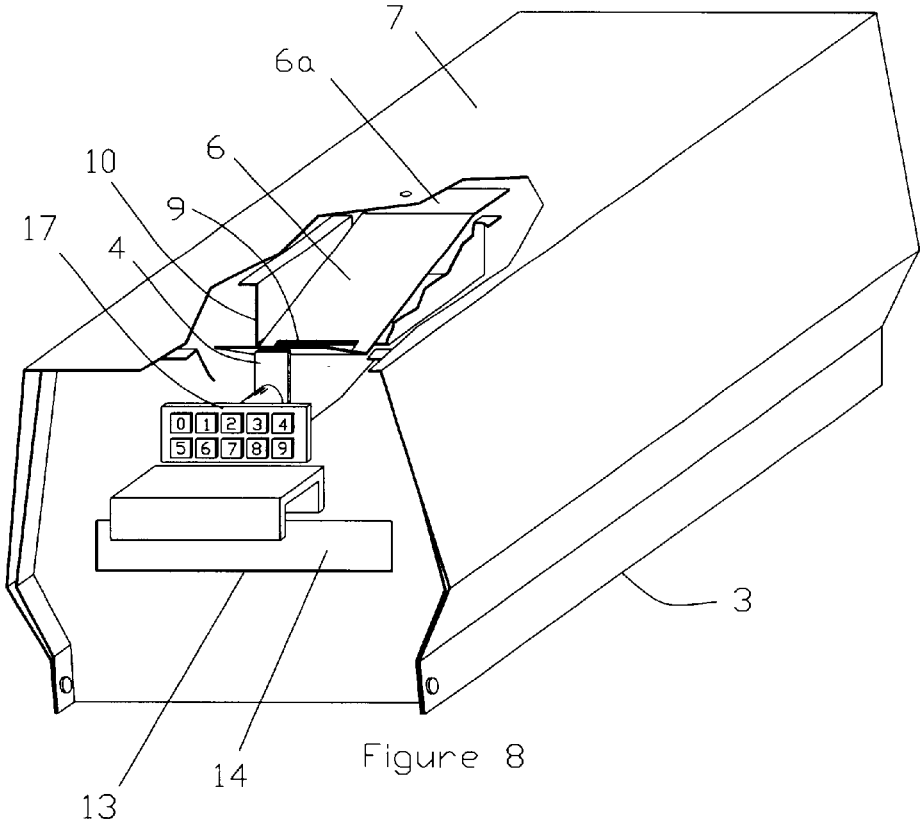
FIG. 8 is an alternate embodiment incorporating a keypad in place of a key lock.

FIG. 8 is an isometric view similar to FIG. 1 but shows a keypad, 17, in place of the key lock, 5.

Although the invention is described with respect to preferred embodiments, modifications thereto will be apparent to those skilled in the art. Therefore, the scope of the invention is to be determined by reference to the claims which follow.

I claim:

1. A security mailbox comprising:

a housing defining an interior and an open end;

a door defining inner and outer surfaces and pivotally attached to the housing for closing and opening the open end of the housing;

a pivot axis of the door located with respect to the center of gravity of the door so that the door is held in a near closed but not locked position by gravity;

a mail slot in the door through which a mail carrier can insert the mail if the door is locked;

a cover over the mail slot;

a latch and catch assembly such that the door can be wide open, or closed but not locked, or closed and locked, said latch and catch assembly consisting of;

a latching member attached to the door that can be positioned with a key lock to either engage or not engage a catch;

said catch is fixedly attached at one end of the catch to the housing while the other end of the catch is free to deflect;

said catch having enough flexibility so that the free end of the catch can deflect over and engage the latching member;

a camming surface at the free end of the catch such that, as the door is pushed fully closed, the latching, member in the locked position, deflects the catch;

a hole in the catch that receives the latching member locking the door when the door is pushed fully closed, said hole is configured so that the latching member can be rotated to the unlocked position, and a guard positioned over the catch and attached to the housing to prevent a thief from reaching through the mail slot and deflecting the catch to release the door.

2. A mailbox as set forth in claim 1 in which the lock is a combination lock.

3. A mailbox as set forth in claim 1 in which the lock is a keypad.

4. A mailbox as set forth in claims 1, 2, or 3 in which a spring detent holds the door in the closed but not locked position.

* * * * *